US008033412B2

(12) United States Patent
Mayo

(10) Patent No.: US 8,033,412 B2
(45) Date of Patent: Oct. 11, 2011

(54) DOUBLE-WALL DECORATIVE DRINKING VESSEL

(75) Inventor: Tracy W. Mayo, Washington, NC (US)

(73) Assignee: The Mainstreet Collection, Inc., Washington, NC (US)

( * ) Notice: Subject to any disclaimer, the term of this patent is extended or adjusted under 35 U.S.C. 154(b) by 414 days.

(21) Appl. No.: 12/283,366

(22) Filed: Sep. 11, 2008

(65) Prior Publication Data

US 2010/0059522 A1 Mar. 11, 2010

(51) Int. Cl.
*B65D 3/22* (2006.01)
*B65D 85/00* (2006.01)

(52) U.S. Cl. ..... 220/62.12; 220/23.83; 220/23.87; 220/62.14; 220/62.18; 220/669; 206/459.5; 40/310; 40/324

(58) Field of Classification Search ..... 220/23.83, 220/23.87, 62.12, 62.14, 62.18, 669; 206/459.5; 40/306, 310, 324
See application file for complete search history.

(56) References Cited

U.S. PATENT DOCUMENTS

| | | | | |
|---|---|---|---|---|
| 550,033 | A | 11/1895 | Wheeler | |
| 2,725,733 | A | 12/1955 | Davie | |
| 3,394,562 | A | 7/1968 | Coleman | |
| 4,151,923 | A | 5/1979 | Bernardi | |
| 4,273,245 | A | 6/1981 | Hartinger Machalek | |
| 5,894,948 | A * | 4/1999 | Yeh | 215/12.1 |
| 6,213,616 | B1 | 4/2001 | Chien | |
| 6,241,095 | B1 * | 6/2001 | Yencheng | 206/459.1 |
| 6,921,179 | B2 | 7/2005 | Diak/Ghanem | |
| 7,229,181 | B2 | 6/2007 | Diak/Ghanem | |
| 7,631,781 | B2 * | 12/2009 | Chen | 220/703 |
| 2005/0194340 | A1 | 9/2005 | Huang | |
| 2005/0207141 | A1 | 9/2005 | Boesch et al. | |

* cited by examiner

*Primary Examiner* — Anthony Stashick
*Assistant Examiner* — Madison L Wright
(74) *Attorney, Agent, or Firm* — Coats & Bennett, P.L.L.C.

(57) ABSTRACT

A double-walled drinking vessel, e.g., a tumbler, is described that is constructed of a downwardly tapered outer wall with a bottom and a continuous side wall with an upper rim; a inner wall with a bottom and a continuous side wall with an upper rim, the inner wall being spaced inwardly from the outer wall and including a first downwardly tapered section extending downwardly from the rim, a second downwardly tapered section extending upwardly from the bottom, and a continuous cylindrical section of a given height and diameter between the first and second tapered sections; and a decorative fabric band secured around the cylindrical section, the band having a width approximately equal to the width of the cylindrical section and a length at least as great as the diameter of the cylindrical band.

12 Claims, 2 Drawing Sheets

DOUBLE-WALL DECORATIVE DRINKING VESSEL

BACKGROUND OF THE INVENTION (1) Field of the Invention

The present invention relates to a double-wall, insulated drinking vessel, and in particular to a drinking vessel having spaced inner and outer walls, and a decorative band around a cylindrical section of the inner wall.

(2) Description of the Prior Art

Drinking vessels, e.g., glasses, cups, mugs, etc., of the type contemplated by the present invention have a double-wall construction to insulate the vessel's contents. These vessels are normally made of polycarbonate, acrylic, or other transparent plastic and include an inner wall, an outer wall and an air space between the walls. Each wall includes a bottom and a continuous side wall extending upwardly from the periphery of the bottom to a continuous upper rim. The inner and outer walls are joined together at or near their top rims. The walls are downwardly tapered from the rim to the bottom, i.e., the rim diameter is greater than the bottom diameter.

It is also known to incorporate decorative materials within the space between the inner and outer walls. For example, it is known to attach indicia to the surface of the inner wall or to embed decorative objects between the walls. However, the use of ribbons or bands of material as decorative material for insulated glasses has not heretofore been contemplated or taught by the prior art. As a result, coordination between these insulated vessels and materials such as napkins, placemats, etc., has not been available. Therefore, there is a need for a double-wall drinking vessel that can be decorated with ribbons or bands.

SUMMARY OF THE INVENTION

Generally, the double-walled drinking vessel of the present invention is constructed of an outer wall with a bottom and a continuous side wall having an upper rim, and an inner wall with a bottom and a continuous side wall having an upper rim and a continuous cylindrical section intermediate the upper rim and bottom, and a decorative band secured around the cylindrical section. The vessel may be configured as a tumbler, mug, etc., with or without a handle or lid.

The band or ribbon is a continuous strip of flexible material having parallel sides and opposed ends, which are also preferably parallel to each other and perpendicular to the side edges to form a rectangular band or ribbon. The band may be of various materials, e.g., a plastic film, but is preferably a fabric ribbon for aesthetic purposes.

In order to ensure correct placement of the band around the glass so that the band is horizontal and of the same appearance around the vessel, the present invention contemplates a vessel inner wall that includes a cylindrical section around which the band is positioned. Preferably, the cylindrical section spans at least one-fourth to one-half of the height of the inner wall.

The cylindrical section is preferably located equidistant from the inner wall rim and bottom wall. The vessel inner wall may also include downwardly tapered sections above and below said cylindrical section, with the upper tapered section extending from the inner wall rim to the top of the cylindrical section, and the lower tapered section extending downwardly from the bottom of the cylindrical section to the bottom of the inner wall. The outer wall can also be downwardly tapered. The band can be wrapped around the cylindrical section and secured to the inner wall and/or by attaching the ends of the band together. The band ends can overlap to provide a secure attachment.

The inner wall can also include other configurations in addition to the cylindrical section. For example, the vessel inner wall can include a plurality of axially aligned sections of decreasingly smaller diameter above and below the cylindrical section.

To summarize, the present invention is directed to a double-walled vessel constructed of a downwardly tapered outer wall with a bottom and a continuous side wall with an upper rim; an inner wall with a bottom and a continuous side wall. The inner wall is spaced inwardly from the outer wall and includes a first downwardly tapered section extending downwardly from the rim, a second downwardly tapered section extends upwardly from the bottom wall, and a continuous cylindrical section of a given height and diameter between the first and second tapered sections.

A decorative band, e.g., of fabric, is secured around the cylindrical section. The band has a width approximately equal to the width of the cylindrical wall section and a length at least as great at the diameter of the cylindrical wall section so that the band extends entirely around the inner wall with the top and bottom edges of the ribbon being parallel to the top rim of the vessel.

DETAILED DESCRIPTION OF THE INVENTION

Figure 1:
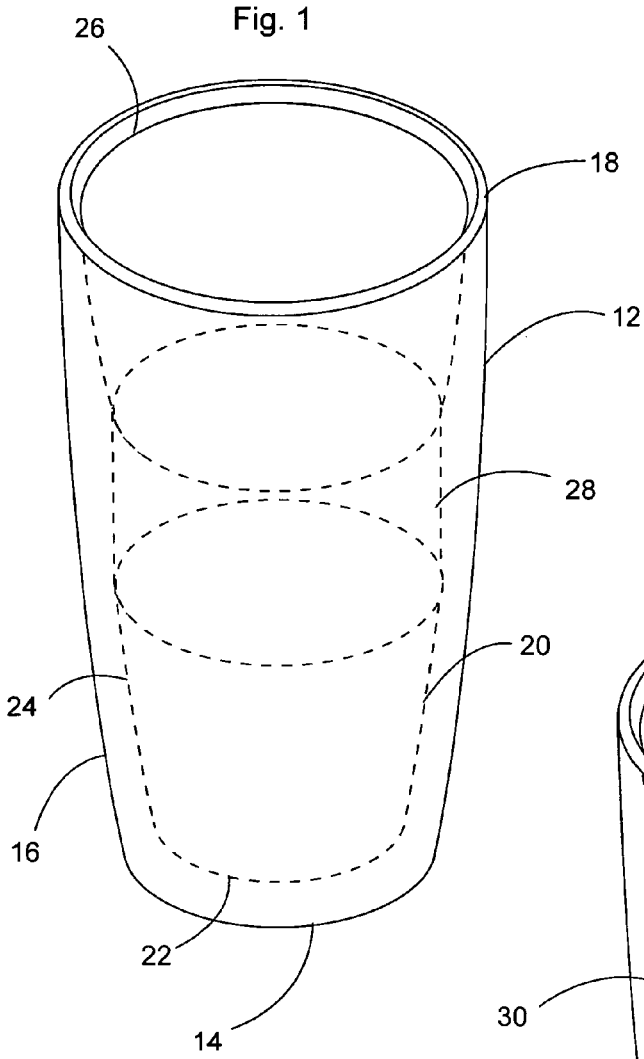
FIG. 1 is a perspective view of the drinking vessel of the present invention without the ribbon attached.
Figure 2:
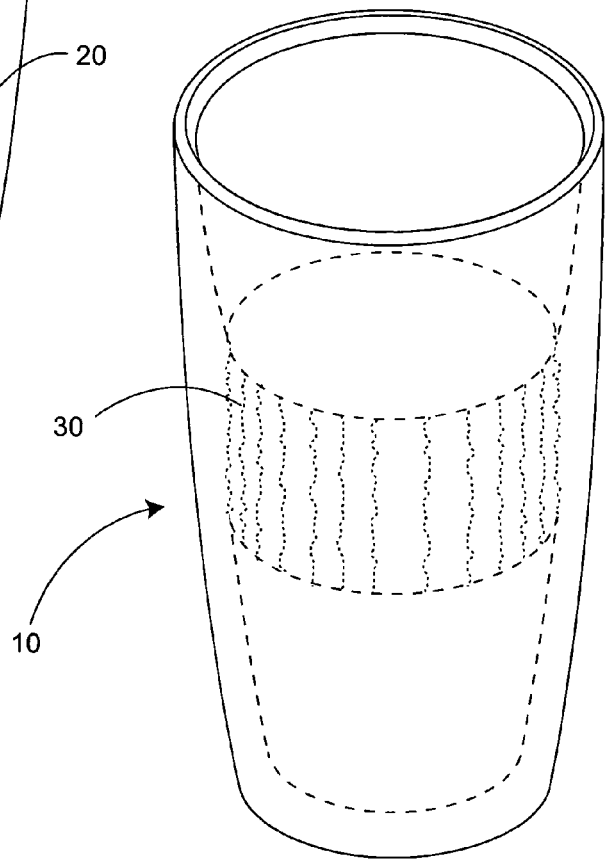
FIG. 2 is a perspective view of the drinking vessel of the present invention with the ribbon attached.
Figure 3:
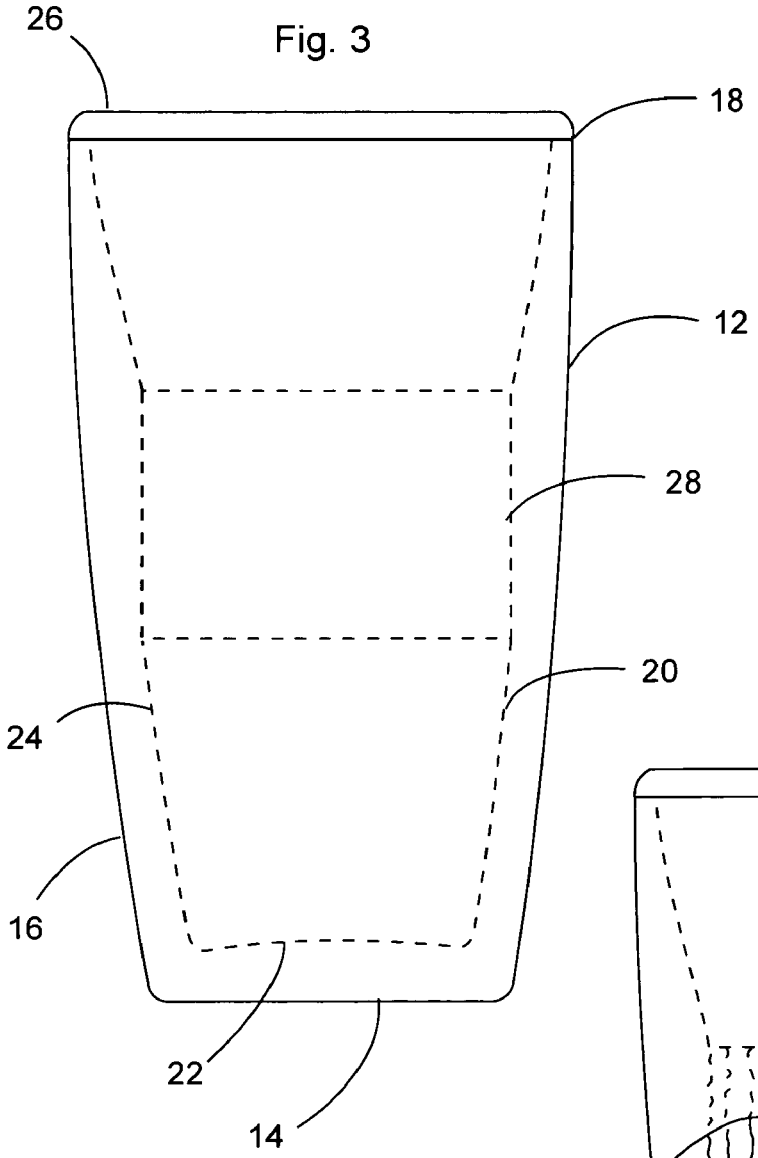
FIG. 3 is a side view of the drinking vessel without the ribbon attached.
Figure 4:
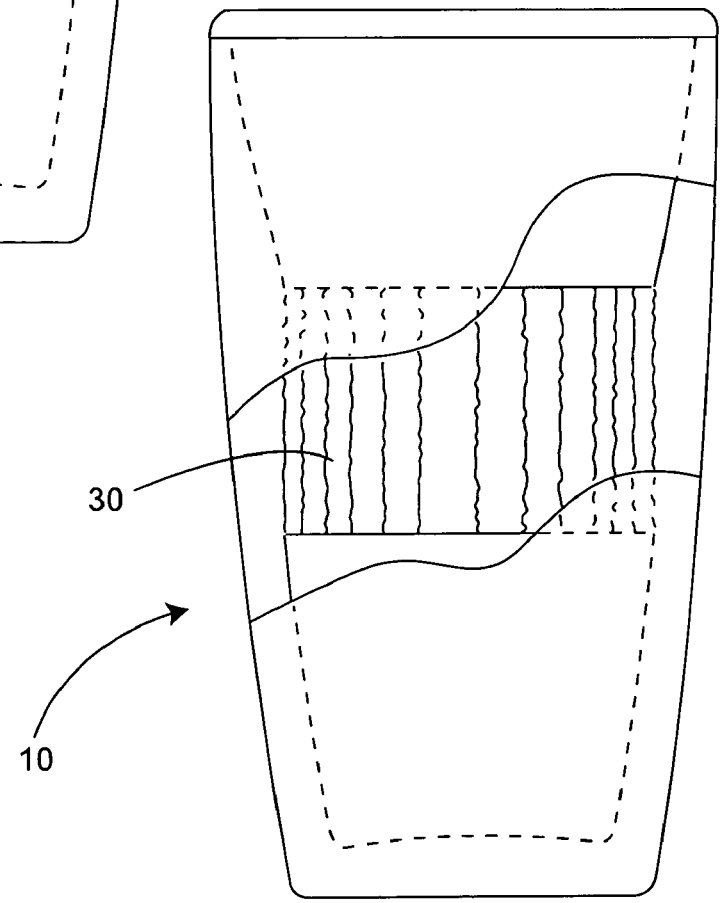
FIG. 4 is a side view of the drinking vessel with the ribbon attached and a section cut away for illustration.

In the following description, terms such as horizontal, upright, vertical, above, below, beneath, and the like, are used solely for the purpose of clarity in illustrating the invention, and should not be taken as words of limitation. The drawings are for the purpose of illustrating the invention and are not intended to be to scale.

As illustrated in the drawings, the double-walled drinking vessel of the present invention, generally 10, is constructed of an outer wall (sometimes referred to as an outer container) 12 with a bottom 14 and a continuous side wall 16 with an upper rim 18, and an inner wall (sometimes referred to as an inner container) 20 with a bottom 22 and a continuous side wall 24 with an upper rim 26. Inner wall 20 includes a continuous cylindrical section 28 intermediate rim 26 and bottom wall 22. As illustrated, section 28 is equidistant between rim 26 and bottom wall 22.

Decorative band 30 is secured around cylindrical section 28. As a result of the cylindrical configuration of the wall section around which band 30 is placed, with section 28 being axially aligned with the vertical axis of vessel 10, the top and bottom edges of band 30 are horizontal all around vessel 10 and parallel to rim 26, providing an aesthetically pleasing design. The ends of band 24 can overlap to provide a secure attachment. While not necessary to the present invention, inner wall 20 can also include a plurality of axially aligned sections of decreasingly smaller diameter above and below the cylindrical section 28, the aligned sections being of significantly smaller height than cylindrical section 28.

Vessel 10 is assembled by securing band 30 around cylindrical section 28 of inner wall 20. Inner wall 20 is then inserted into outer wall 12 until the upper rims of the two walls are joined. The rims are then attached to each other in a known manner.

Certain modifications and improvements will occur to those skilled in the art upon a reading of the foregoing description. It should be understood that all such modifications and improvements have been deleted herein for the sake of conciseness and readability but are properly within the scope of the following claims.

What is claimed is:

1. A double-walled tumbler comprising:

a. a downwardly tapered outer wall with a bottom and a continuous side wall with an upper rim;

b. an inner wall with a bottom and a continuous side wall with an upper rim, said inner wall being spaced inwardly from said outer wall and including a first downwardly tapered section extending downwardly from said rim, a second downwardly tapered section extending upwardly from said bottom, and a continuous cylindrical section of a given height and diameter between said first and second tapered sections;

c. wherein the cylindrical section includes a height and a constant diameter throughout the height of the cylindrical section;

d. wherein the inner wall is non-linear and the first, second, and cylindrical sections of the inner wall form a plurality of angles in the inner wall;

e. wherein the inner wall forming the cylindrical section extends perpendicular with respect to the bottom of the outer wall; and f. a decorative fabric band secured around said cylindrical section, said band having a width approximately equal to the width of said cylindrical section and a length at least as great at the diameter of said cylindrical section.

2. The vessel of claim 1, wherein the height of said cylindrical section is about one-fourth to one-half of the height of said inner wall.

3. The vessel of claim 1, wherein said cylindrical section is approximately equidistant between said inner wall bottom and upper rim.

4. The double-wall tumbler of claim 1 wherein the side wall of the inner container forming the first section forms an angle with the side wall of the inner container forming the cylindrical section and wherein the side wall of the inner container forming the second section forms an angle with the side wall of the inner container forming the cylindrical section.

5. A double-wall tumbler comprising:

a. an outer container having an open top, a bottom, and a side wall that tapers downwardly and inwardly from the open top towards the bottom of the outer container;

b. an inner container disposed and held in the outer container;

c. the inner container including an open top, a bottom, and a side wall;

d. the side wall of the inner container is spaced from the side wall of the outer container:

e. wherein a portion of the side wall of the inner container forms an upper section that tapers downwardly and inwardly from the top of the inner container;

f. wherein a portion of the side wall of the inner container forms a lower section that tapers upwardly and outwardly from the bottom of the inner container;

g. wherein a portion of the side wall of the inner container forms an intermediate cylindrical section disposed between the upper and lower sections;

h. wherein the portion of the side wall of the inner container forming the intermediate cylindrical section is of a constant diameter, and wherein the portion of the side wall of the inner container forming the intermediate cylindrical section extends perpendicular relative to the bottom of the outer container;

i. wherein the side wall of the inner container is non-linear and the portion of the side wall of the inner container forming the upper section forms an angle with the portion of the side wall of the inner container forming the intermediate cylindrical section, and wherein the portion of the side wall of the inner container forming the lower section forms an angle with the portion of the side wall of the inner container forming the intermediate cylindrical section; and j. a decorative ribbon secured around the cylindrical section of the side wall of the inner container such that the decorative ribbon is disposed between the cylindrical section of the side wall of the inner container and the side wall of the outer container.

6. The double-wall tumbler of claim 5 wherein the side wall of the inner container and the side wall of the outer container include continuous upper rims, and wherein the upper rims are joined to form an air tight compartment between the inner and outer containers.

7. The double-wall tumbler of claim 5 wherein the cylindrical section of the side wall of the inner container is approximately one-fourth to approximately one-half of the height of the side wall of the inner container.

8. The double-wall tumbler of claim 5 wherein the decorative ribbon includes opposed ends, and wherein the opposed ends are overlapped.

9. The double-wall tumbler of claim 5 wherein the decorative band includes a width that approximately equals a width of the cylindrical section.

10. The double-wall tumbler of claim 5 wherein the decorative band is constructed of fabric.

11. The double-wall tumbler of claim 5 wherein the decorative ribbon only extends around the intermediate cylindrical section and not the upper and lower sections of the side wall of the inner container.

12. The double-wall tumbler of claim 11 wherein the decorative ribbon includes an upper edge that terminates immediately adjacent a lower end of the upper section of the side wall of the inner container, and wherein the decorative ribbon includes a lower edge that terminates immediately adjacent an upper end of the lower section of the side wall of the inner container.

* * * * *